United States Patent [19]

Waugh

[11] 4,429,439

[45] Feb. 7, 1984

[54] GARMENT EXPANDER

[76] Inventor: Edward F. Waugh, 8508 Harris Ave., Baltimore, Md. 21234

[21] Appl. No.: 458,474

[22] Filed: Jan. 17, 1983

[51] Int. Cl.[3] ..... A44B 13/00

[52] U.S. Cl. ..... 24/573; 2/235; 2/141 R; 2/219; 24/683

[58] Field of Search ..... 24/226, 227, 370, 371, 24/236, 259, 91, 93; 2/41 R, 41 A, 312, 321, 322, 265, 219, 235, 236, 237

[56] References Cited

U.S. PATENT DOCUMENTS

| | | | |
|---|---|---|---|
| 1,074,905 | 10/1913 | Smith . | |
| 2,108,905 | 2/1938 | Sheer | 24/256 |
| 2,148,848 | 2/1939 | Urley | 24/259 |
| 2,194,100 | 3/1940 | Shilker | 24/226 X |
| 2,585,689 | 2/1952 | Schafer | 2/141 |
| 2,630,572 | 3/1953 | Yuckin | 2/42 |
| 2,893,094 | 7/1959 | Heckethorn | 24/236 |
| 2,983,006 | 5/1961 | Schafer | 24/73 |
| 3,172,179 | 3/1965 | Shafer | 24/91 |
| 3,936,914 | 2/1976 | Mancini | 24/226 X |

*Primary Examiner*—James T. McCall
*Assistant Examiner*—Peter A. Aschenbrenner
*Attorney, Agent, or Firm*—John F. McClellan, Sr.

[57] ABSTRACT

A garment expander, of the type equipped with a bent sheet metal hook on one flap of the fly opening for hooking through a bent sheet metal eye on the other flap of the flap opening, has at one end a resilient loop which strongly but detachably captures the eye and has at the other end a planar area with a rigid bridge protruding from the planar area in a plane parallel with it for aligning and engaging the trouser hook; when tension is applied the loop may permit the eye to turn slightly within the loop for better trouser appearance; the invention is adapted for high-volume low-cost production with minimum operations.

6 Claims, 5 Drawing Figures

GARMENT EXPANDER

FIELD OF THE INVENTION

This invention relates generally to fastening devices and particularly to tension fasteners adapted for insertion between the attaching ends of a loop-forming garment member to extend the size of the loop.

In the prior art the general concept of apparatus for extending an encircling garment member has been disclosed:

U.S. Pat. No. 1,074,905 to E. B. Smith, Oct. 7, 1913, teaches a sheet metal type hook-and-eye structure;

U.S. Pat. No. 2,108,905 to H. Sheer, 2-22-38, teaches a base member with loop and hook attached to one face of it;

U.S. Pat. No. 2,148,848 to W. R. Wiley, Feb. 28, 1939, teaches two forms of clips which are sheet metal and have a hook and an eye;

U.S. Pat. No. 2,630,572 to H. Gluckin, Mar. 10, 1953, teaches securing a waistband with hook structure;

U.S. Pat. No. 2,585,689 to J. V. Shafer, May 9, 1961, teaches a particular form of loop and button structure;

U.S. Pat. No. 2,893,094 to J. E. Heckethorn, July 7, 1959, teaches a sheet metal hook with a rectangular perforate end;

U.S. Pat. No. 2,893,006 to J. V. Schafer, May 9, 1961, teaches another form of loop and buttom structure;

U.S. Pat. No. 3,172,179 to J. V. Schafer, Mar. 9, 1965, teaches still another form of loop and button structure.

SUMMARY OF THE INVENTION

This invention provides means for extending the waist encircling loop of trousers and the like, such as shorts and women's slacks and skirts.

Although some of the above patents have disclosed apparatus somewhat pertinent to this invention, no known apparatus has provided at the same time the combination of extreme efficiency, stability and economy, of this invention which, according to the principal object of this invention can make it a standard of commerce for the purpose.

Further object are to provide a system for extending waistband fastening of trousers for use with trouser hooks and eyes which is easy and convenient to use, which cannot be attached wrong; which provides a broad area for tactile orientation in applying it, for grasping during attachment, for stabilizing, and for shielding the user's waist against pressure from trouser hooks; and which provides desirable slack in engagement with a pants eye so that the other eye can be more easily attached to a pants hook.

Yet further objects and to provide a system as described which is loss-resistant because of spring force holding it to a pants eye, which has a sloped entry area so that it attaches and detaches readily from the eye when desired; which provides a broad face guide surface for engaging a pants hook detachably, and which can be fastened either-end-first.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
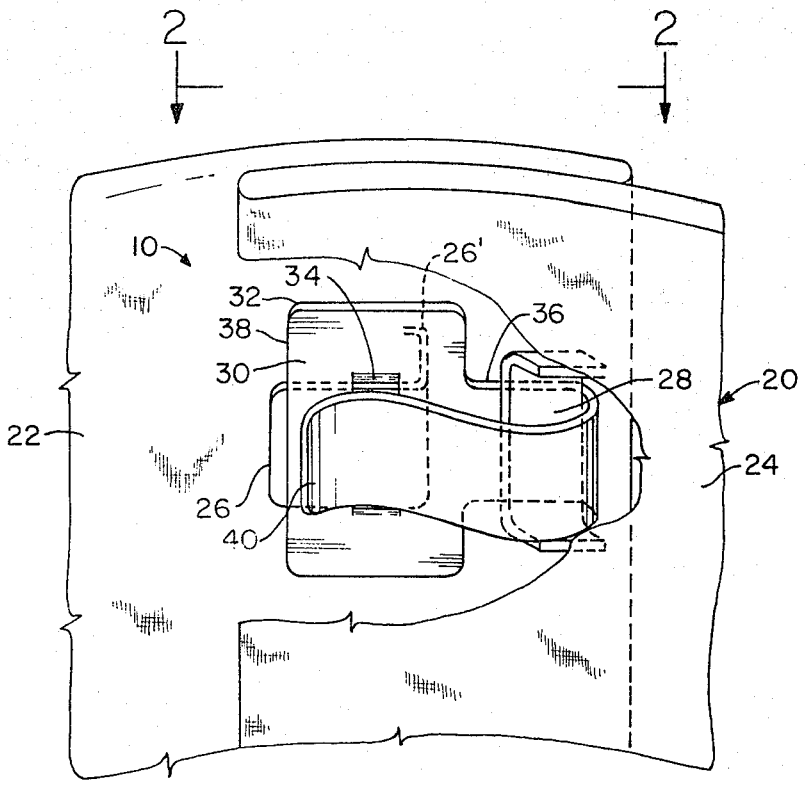
FIG. 1 is a perspective view with a portion broken away, looking out from inside a pair of trousers, of the invention installed at the waistband of the pair of trousers, engaging at the left a conventional trouser hook and at the right a conventional trouser eye.

FIG. 1 shows the invention 10 installed in a pair of trousers 20, holding the left and right waistband flaps 22, 24 together at the fly opening.

The waistband end or flap 22 on the left of the fly opening has conventionally a bent sheet-metal hook 26 fixed inside it to protrude inwardly towards the user.

The hook is positioned for engaging a conventional squared-"U" bent sheet metal eye 28 fixed to protrude outward from the outer face of the waistband flap 24, on the right of the fly opening and drawn partly broken away to show details of the eye and of the invention.

In the Figures the anchorage of the eye 28 to the trousers is not indicated but is has areas inside the garment like that of the hook at 26', which affix it as by clamping or sewing.

Because trouser wearers get fatter or bloated or buy trousers too small in the waist, they often unhook the hook-and-eye for relief from constriction at the waist. This can jam or tear the zipper fastener on a pair of trousers by subjecting it to a load for which it was not designed, and can, in any event, produce wrinkles in trousers by lowering the waist constraint.

The invention 10 removes both these objections. As shown, it spans the gap between hook 26 and eye 28 when the hook and eye are dis-engaged, permitting an inch (2.5cm) or so expansion at the waist.

The invention includes a unitary member or system of sheet metal construction. In this, there is a rectangular portion 30 or first portion with rounded corners 32 and having on the first or outer face a vertical or transverse stamped-out bridge 34, for receiving and holding the trouser hook 26. Extending laterally in-plane from the rectangular portion is a relatively narrow parallel-side second portion or arm loop portion 36 which loops over itself and then over the rectangular portion, forming a "U"-loop and terminating adjacent the far edge 38 of the rectangular portion. There it recurves as an outward jaw 40 from the second or inner face of the rectangular portion providing an incline easing introduction of the trouser eye 28 into it.

Figure 2:
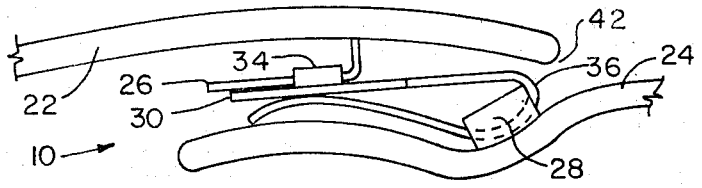
FIG. 2 is a view adapted from 2—2, FIG. 1.

FIG. 2 shows a view looking vertically down, otherwise generally like the FIG. 1 view.

The left-hand trouser flap is shown at 22 with the trouser hook 26 engaged under the bridge 34 of the invention 10. The righthand trouser flap is shown at 24 with the loop 36 of the invention engaging the eye 28.

Tension does not turn the invention in spite of the out-of-plane relation of the hook and eye because of the flat engagement of the hook 26 along flat face of the rectangular portion 30 on either side of the bridge. However, tension can and does ride the eye 28 along the slope of the loop 36, turning the eye 28 and advantageously tending to turn the righthand flap at 24 outward, reducing the gap 42 between the flaps.

Figure 3:
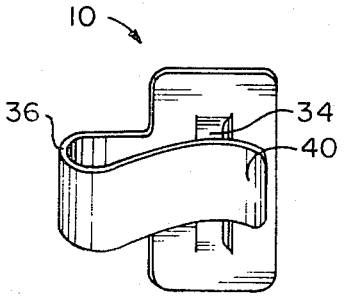
FIG. 3 is a perspective view showing a face of the invention.

FIG. 3 shows the back or interior face of the invention 10 in a view similar to that of the first Figure. In this view the bridge 34 is stamped out away from the view and is therefore concave in appearance, and has the arm loop and recurve 36, 40 turned back over it.

Figure 4:
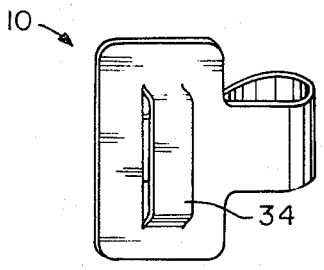
FIG. 4 is a perspective view showing the other face of the invention.

FIG. 4 shows the front or exterior face of the invention 10. The bridge 34 is convex in this view.

Figure 5:
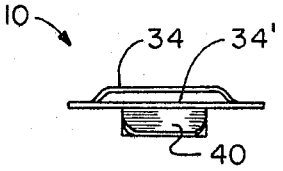
FIG. 5 is an end elevational view.

FIG. 5 shows an end view of the invention 10 showing the bridge 34 with spacing 34' beneath it for free passage of a trouser hook in engaging and disengaging, and showing the open end jaw incline 40 of the loop, for receiving a trouser eye. Resilient closure of the loop requires substantial force to free an eye from it, in contrast with the engagement of hook and bridge. This prevents loss of the unitary member of this invention since deliberate application of force in the releasing direction must be applied to detach the loop.

Only two operations are necessary to form the shape of the invention. First, a flat sheet of spring steel is stamped to produce the outline shape and simultaneously lance out the bridge 34, and next the arm is looped back to the desired configuration. The part may then be tumbled to remove sharp edges, spring tempered, and, if desired, plated or painted.

No metal is wasted in producing the bridge; the sides are simply cut and the bridge pushed out. The outline shape is adapted for nested production to reduce waste.

Blank material may be 1/32 inch thick (0.8 mm) thick by 2 inches (5.1 cm) long; the rectangular portion may be $\frac{1}{2}$ by $\frac{3}{4}$ inches (13 by 18 mm); the bridge may be $\frac{1}{8}$ inch (3 mm) wide and centrally in the rectangular portion. The loop may project $\frac{3}{8}$ inch (9.1 mm) from the rectangular portion and be 5/16 inch (7.8 mm) wide.

These dimensions make the unit comfortable but compact and secure in use, and will expand a garment waist by $\frac{3}{4}$ inch (18 mm).

It will be appreciated that the arm length may be produced in other sizes such as $\frac{1}{2}$ inch to $\frac{1}{4}$ inches (13 mm to 31 mm) to add specified comfort increment or waist extensions to trousers.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for extending waistband fastening of trousers, the improvement comprising: said trousers being of the type having at the waistband fly opening a hook protruding inwardly from the inner surface of a lefthand flap and an eye protruding outwardly from the outer surface of a righthand flap for engaging the hook to hold the right hand and left hand flaps together, when hooked; means for connecting said hook and eye when said hook and eye are not engaged to each other and are at a distance from each other caused by waistband extension, including: the means for connecting being a unitary member of sheet material, a first portion of said unitary member forming a bridge for engaging said hook, and a second portion of said unitary member forming a loop for engaging said eye within said loop.

2. In a system as recited in claim 1, said first portion having an outer face and an inner face, said first portion being substantially flat and said bridge protruding outwardly on said outer face, and said second portion being transverse to the bridge and curving around as said loop and crossing said inner face.

3. In a system as recited in claim 2, means for introduction of said eye into said loop, comprising said second portion terminating as a jaw portion inclined away from said inner face.

4. In a system as recited in claim 1, said bridge having a space therebeneath proportioned for freely engaging said hook and freely disengaging from the hook, and said loop porportioned for resiliently closing around the eye and requiring substantial force to be applied to release said eye from the loop.

5. In a system as recited in claim 1, said loop proportioned for permitting the eye to turn within the loop in response to waistband extension.

6. In a system as recited in claim 1, means for preventing said unitary member from rotating when engaged with the hook, comprising a respective flat portion of said unitary member on each side of the bridge in position for supporting the unitary member on the hook against rotation.

* * * * *